US005575823A

United States Patent [19]

Wallace et al.

[11] Patent Number: 5,575,823

[45] Date of Patent: Nov. 19, 1996

[54] DIESEL FUEL COMPOSITIONS

[75] Inventors: Graeme M. Wallace, Wokingham; James P. Simmonds, Horbury, both of United Kingdom

[73] Assignee: Ethyl Petroleum Additives Limited, Bracknell, England

[21] Appl. No.: 632,355

[22] Filed: Dec. 21, 1990

[30] Foreign Application Priority Data

Dec. 22, 1989 [GB] United Kingdom ..... 89-29119

[51] Int. Cl.[6] ..... C10L 1/30

[52] U.S. Cl. ..... 44/359; 44/342; 44/347; 44/450

[58] Field of Search ..... 44/342, 347, 359, 44/450

[56] References Cited

U.S. PATENT DOCUMENTS

| | | | |
|---|---|---|---|
| 3,094,472 | 6/1963 | Greenwald et al. | 44/342 |
| 3,112,789 | 12/1963 | Percy et al. | 44/359 |
| 3,197,414 | 7/1965 | Wood | 252/386 |
| 3,202,141 | 8/1965 | Lovell | 123/1 |
| 3,216,936 | 11/1965 | LeSuer | 44/331 |
| 3,307,928 | 3/1967 | Chaikivsky et al. | 44/63 |
| 3,490,882 | 1/1970 | Dunworth | 44/73 |
| 3,582,295 | 6/1971 | Balash | 44/63 |
| 3,701,641 | 10/1972 | Rakow et al. | 44/73 |
| 3,883,320 | 5/1975 | Sturkl | 44/68 |
| 3,891,401 | 6/1975 | Watson et al. | 44/68 |
| 3,909,215 | 9/1975 | Kray | 44/62 |
| 3,927,995 | 12/1975 | Romans | 44/342 |
| 3,994,698 | 11/1976 | Worrel | 44/58 |
| 4,022,589 | 5/1977 | Alquist et al. | 44/58 |
| 4,047,900 | 9/1977 | Dorn et al. | 44/68 |
| 4,116,644 | 9/1978 | Jackisch et al. | 44/73 |
| 4,207,078 | 6/1980 | Sweeney et al. | 44/352 |
| 4,240,801 | 12/1980 | Desmond, Jr. | 44/326 |
| 4,240,803 | 12/1980 | Andress, Jr. | 44/63 |
| 4,247,300 | 1/1981 | Benazza et al. | 44/342 |
| 4,390,345 | 6/1983 | Somorjai | 44/63 |
| 4,781,730 | 11/1988 | Stoldt et al. | 44/71 |
| 4,857,073 | 8/1989 | Vataru et al. | 44/345 |

FOREIGN PATENT DOCUMENTS

| | | | |
|---|---|---|---|
| 0203692 | 12/1986 | European Pat. Off. . | |
| 0207560 | 1/1987 | European Pat. Off. . | |
| 0235868 | 9/1987 | European Pat. Off. . | |
| 0078249 | 10/1987 | European Pat. Off. . | |
| 0251419 | 1/1988 | European Pat. Off. . | |
| 0355895 | 2/1990 | European Pat. Off. . | |
| 0385633 | 9/1990 | European Pat. Off. . | |
| 901689 | 7/1962 | United Kingdom | 44/359 |
| 1413323 | 11/1975 | United Kingdom . | |
| 8500827 | 2/1985 | WIPO . | |
| 8701126 | 2/1987 | WIPO . | |
| 8905339 | 6/1989 | WIPO . | |
| 8907126 | 8/1989 | WIPO . | |

OTHER PUBLICATIONS

Zubarev et al, "Lowering Carbon Deposition in Ship Diesels", *Rybn. Khoz. (Moscow),* vol. 9, pp. 52–54 (1977). (original and translation).

Shmidt et al, "Use of manganese antiknock compound 2–Ts8 for improving the octane characteristics of gasoline", *Neftepererab. Neftekhim. (Moscow),* (11), pp. 8–10 (1972) (original and translation).

Keszthelyi et al, "Testing the combustion properties of light fuel oils", *Period. Polytech., Chem. Eng.,* 21(1), pp. 79–93 (1977) (original and translation).

Borisov et al, "Features of the ignition of combustible liquid mixtures", *Dokl. Akad. Nauk SSSR,* 247(5), pp. 1176–1179 (1979) (original and translation).

Mutalibov et al, "Effect of additives on the combustion of fuel for internal–combustion engines", *Dokl. Akad. Nauk SSSR,* 250(5), pp. 1194–1196 (1980) (original and translation).

Bartels et al, "Determination of tricarbonylcyclopentadienyl(methyl)manganese JP–4 fuel by atomic absorption spectrophotometry", *Atomic Absorption Newsletter,* 8(1), pp. 3–5 (1969).

Makhov et al, "Effect of cyclopentadienyltricarbonylmanganese additives to diesel fuel on the course of the soot formation process", *Margantsevye Antidetonatory,* 192–9 (1971) (original and translation).

Belyea, "The CI–2 manganese based additive reduces the concentration of sulfur trioxide in flue gases", *Il Calore,* No. 3, pp. 135–137 (1967) 250(5), pp. 1194–1196 (1980) (original and translation).

*Primary Examiner*—Jerry D. Johnson
*Attorney, Agent, or Firm*—Dennis H. Rainear

[57] ABSTRACT

Heavy diesel fuels, especially those containing sulphur and intended for marine or railroad use, are improved by incorporation therein of a combination of a cyclomatic manganese tricarbonyl and an ashless dispersant and optionally an antioxidant. Diesel fuels so modified show improved combustion characteristics and fuel economy.

24 Claims, No Drawings

DIESEL FUEL COMPOSITIONS

This invention relates to diesel fuels, to additive packages for incorporation therein, and to their use.

Improved fuel economy is a constant objective of all users of internal combustion engines as the cost of the fuel is a major component of operating costs. This is especially true for users of internal combustion engines used to drive land vehicles, ships, or stationary engines. Even a small improvement in fuel economy can result in a valuable reduction of operating costs. In addition it is useful to reduce the emissions of internal combustion engines, and any improvement in fuel economy contributes to this objective. This is particularly true where the engine is fuelled with a heavy (i.e. relatively viscous and non-volatile) hydrocarbon fuel, as is the case with many marine diesel engines and other heavy diesel engines used to drive vehicles. Such fuels often contain relatively high contents of sulphur which, as is well known, is an important contributor to pollution caused by exhaust gases, and also have relatively poor combustion characteristics which can constitute a limiting factor in the performance of the diesel engine burning them.

There is therefore a need to be able to improve combustion efficiency and economy of heavy diesel engines, especially marine diesel engines, which burn heavy hydrocarbon fuels especially those containing appreciable amounts of sulphur.

The present invention provides a heavy diesel fuel composition which has been shown to have improved combustion characteristics in use which lead to a valuable improvement in fuel economy and a reduction in the amount of exhaust gases produced. The heavy diesel fuel composition of the present invention comprises a cyclomatic manganese tricarbonyl (as hereinafter defined), an ashless dispersant, and preferably also an antioxidant. The proportion of the cyclomatic manganese tricarbonyl compound should be from 0.00025 to 0.15%, preferably 0.000625 to 0.075% by weight based on the weight of the fuel. The proportion of the ashless dispersant should be from 0.0125 to 0.99%, preferably 0.025 to 0.495% by weight based on the weight of the fuel, and the proportion of the antioxidant (when present) should be from 0 to 0.2, usually 0.01 to 0.1% by weight based on the weight of the fuel.

The cyclomatic manganese tricarbonyl compound, the ashless dispersant and the optional antioxidant are conveniently supplied to the user, i.e. the supplier or user of the diesel fuel, in the form of a package comprising these ingredients, which may, if desired, be supplied in solution or stable dispersion in diesel fuel oil or other suitable diluent oil compatible with the diesel fuel into which the additives are to be incorporated, e.g. a mineral or synthetic lubricating oil, a hydrocarbon solvent, or an oxygenated hydrocarbon solvent such as an alcohol or ester. Such a package may contain from 1 to 15%, preferably 2.5 to 7.5% by weight of the cyclomatic manganese tricarbonyl compound, from 50 to 99%, preferably 70 to 90%, by weight of the ashless dispersant, and from 0 to 20% by weight of the optional antioxidant. The presence of the diluent oil is optional, but inclusion of such diluent can facilitate the incorporation of the package of additives into the diesel fuel. Typically, the package is incorporated in the fuel in a proportion of 0.025 to 1% by weight of the package based on the weight of the fuel, preferably 0.05 to 0.5% by weight.

The present invention is especially useful for use with heavy diesel fuels for marine or railroad use. The requirements for such fuels have been laid down in numerous industrial standards. Reference may be made to ISO Standards DIS 8217 having the designations ISO-F- DMX, DMA, DMB, and DMC; to BSI Standards BS MA 100 (1982) classes M1, M2 and M3; and to the CIMAC 1 recommended standard. These are distillate marine fuel standards. Residual marine fuel standards have been issued by the same standardization authorities: ISO DIS DP 8217 having the designations ISO-F- RMA-10, RMB-10, RMC-10, RMD-15, RME-25, RMF-25, RMG-35, RMH-35, RMK-35, RML-35, RMH-45, RMK-45, RML-45, RMH-55 and RML-55; BSI Standards BSMA 100 (1982) classes M4, M5, M6, M7, M8, M9, M10, M11 and M12; and CIMAC recommended standards 2, 3, 4, 5, 6, 7, 8, 9, 10, 11 and 12. Such standards are described in, for example, ASTM Publication Code PCN 04-878000-12, "Marine Fuels" by Thornton et al (December, 1983).

In general terms the heavy diesel fuels in connection with which the present invention is especially useful contain at least 0.5% of sulphur, usually 1% or more up to about 5%. They have a density of at least 0.88 g/ml up to a maximum of about 1. The viscosity may vary from about 10 to about 500 centistokes (cSt) at 50° C., but is usually in the range of 100 to 500 cSt at 50° C.

The cyclomatic manganese tricarbonyl compounds used in the present invention are described in the literature, for example U.S. Pat. No. 3,015,668. They may be represented by the general formula:

$$CyMn(CO)_3$$

where Cy represents a cyclomatic hydrocarbon radical, i.e. a hydrocarbon radical containing a cyclopentadienyl nucleus. Typical of such hydrocarbon radicals are those represented by the formulae:

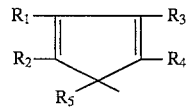

and

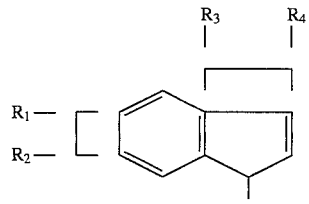

where the radicals $R_1$, $R_2$, $R_3$, $R_4$ and $R_5$ are each hydrogen or a monovalent hydrocarbon radical, e.g. an alkyl radical of up to 4 carbon atoms, phenyl, or alkylphenyl in which the alkyl contains up to 4 carbon atoms. Preferred such radicals Cy contain from 5 to about 13 carbon atoms each, and examples of the radical Cy are cyclopentadienyl, indenyl, methylcyclopentadienyl, propylcyclopentadienyl, diethylcyclopentadienyl, phenylcyclopentadienyl, tert-butylcyclopentadienyl, p-ethyphenylcyclopentadienyl, 4-tert-butyl indenyl, and the like. Specific preferred cyclomatic manganese tricarbonyl compounds which can be used in the present invention are cyclopentadienyl manganese tricarbonyl, methylcyclopentadienyl manganese tricarbonyl, indenyl manganese tricarbonyl, and ethylcyclopentadienyl manganese tricarbonyl. Methylcyclopentadienyl manganese tricarbonyl is commercially available and is preferred.

Ashless dispersants are described in numerous patent specifications, mainly as additives for use in lubricant compositions, but their use in hydrocarbon fuels has also been described. Ashless dispersants leave little or no metal containing residue on combustion. They generally contain only carbon, hydrogen, oxygen and nitrogen, but sometimes contain in addition other non-metallic elements such as phosphorus, sulphur or boron.

The preferred ashless dispersant is an alkenyl succinimide of an amine having at least one primary amine group capable of forming an imide group. Representative examples are given in U.S. Pat. No. 3,172,892; U.S. Pat. No. 3,202,678; U.S. Pat. No. 3,219,666; U.S. Pat. No. 3,272,746; U.S. Pat. No. 3,254,025, U.S. Pat. No. 3,216,936, and U.S. Pat. No. 4,234,435. The alkenyl succinimides may be formed by conventional methods such as by heating an alkenyl succinic anhydride, acid, acid-ester or lower alkyl ester with an amine containing at least one primary amine group. The alkenyl succinic anhydride may be made readily by heating a mixture of olefin and maleic anhydride to about 180°–220° C. The olefin is preferably a polymer or copolymer of a lower monoolefin such as ethylene, propylene, isobutene and the like. The more preferred source of alkenyl group is from polyisobutene having a molecular weight up to 10,000 or higher. In a still more, preferred embodiment the alkenyl is a polyisobutene group having a molecular weight of about 700–5,000 and most preferably about 900–2,000.

Amines which may be employed include any that have at least one primary amine group which can react to form an imide group. A few representative examples are: methylamine, 2-ethylhexylamine, n-dodecylamine, stearylamine, N,N-dimethyl-propanediamine, N-(3-aminopropyl)morpholine, N-dodecyl propanediamine, N-aminopropyl piperazine ethanolamine, N-ethanol ethylene diamine and the like.

The preferred amines are the alkylene polyamines such as propylene diamine, dipropylene triamine, di-(1,2butylene)-triamine, tetra-(1,2-propylene)pentaamine.

The most preferred amines are the ethylene polyamines which have the formula $H_2N\text{-}(CH_2CH_2NH\text{-})_nH$ wherein n is an integer from one to about ten. These include: ethylene diamine, diethylene triamine, triethylene tetraamine, tetraethylene pentaamine, pentaethylene hexaamine, and the like, including mixtures thereof in which case n is the average value of the mixture. These ethylene polyamines have a primary amine group at each end so can form monoalkenylsuccinimides and bis-alkenylsuccinimides.

Thus especially preferred ashless dispersants for use in the present invention are the products of reaction of a polyethylenepolyamine, e.g. triethylene tetramine or tetraethylene pentamine, with a hydrocarbon substituted carboxylic acid or anhydride made by reaction of a polyolefin, preferably polyisobutene, having a molecular weight of 500 to 5,000, especially 900 to 1,200, with an unsaturated polycarboxylic acid or anhydride, e.g. maleic anhydride.

Another class of useful ashless dispersants includes alkenyl succinic acid esters and diesters of alcohols containing 1–20 carbon atoms and 1–6 hydroxyl groups. Representative examples are described in U.S. Pat. No. 3,331,776; U.S. Pat. No. 3,381,022 and U.S. Pat. No. 3,522,179. The alkenyl succinic portion of these esters corresponds to the alkenyl succinic portion of the succinimides described above including the same preferred and most preferred sub-genus e.g. polyisobutenyl succinic acids wherein the polyisobutenyl group has an average molecular weight of 900–2,000.

Alcohols useful in preparing the esters include methanol, ethanol, isobutanol, octadecanol, eicosanol, ethylene glycol, diethylene glycol, tetraethylene glycol, diethylene glycol monethylether, propylene glycol, tripropylene glycol, glycerol, sorbitol, 1,1,1-trimethylol ethane, 1,1,1,-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g. $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydride can be merely reacted with an appropriate alkylene oxide such as ethylene oxide, propylene oxide, and the like, including mixtures thereof.

In another embodiment the ashless dispersant is an alkenyl succinic ester-amide mixture. These may be made by heating the above-described alkenyl succinic acids, anhydrides or lower alkyl esters with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, trimethylol aminomethane.

Representative examples of suitable ester-amide mixtures are described in U.S. Pat. No. 3,184,474; U.S. Pat. No. 3,576,743; U.S. Pat. No. 3,632,511; U.S. Pat. No. 3,804,763; U.S. Pat. No. 3,836,471; U.S. Pat. No. 3,862,981; U.S. Pat. No. 3,936,480; U.S. Pat. No. 3,948,800; U.S. 3,950,341; U.S. 3,957,854; U.S. Pat. No. 3,957,855; U.S. Pat. No. 3,991,098; U.S. Pat. No. 4,071,548 and U.S. Pat. No. 4,173,540.

Such ashless dispersants containing alkenyl succinic residues may, and is well known, be post-reacted with boron compounds, phosphorus derivatives and/or carboxylic acid acylating agents, e.g. maleic anhydride.

Another useful class of ashless dispersants includes the Mannich condensates of hydrocarbyl-substituted phenols, formaldehyde or formaldehyde precursors (e.g. paraformaldehyde) and an amine having at least one primary amine group and containing 1–10 amine groups and 1–20 carbon atoms. Mannich condensates useful in this invention are described in U.S. Pat. No. 3,442,808; U.S. Pat. No. 3,448,047; U.S. Pat. No. 3,539,633; U.S. Pat. No. 3,591,598; U.S. Pat. No. 3,600,372; U.S. Pat. No. 3,634,515; U.S. Pat. No. 3,697,574; U.S. Pat. No. 3,703,536; U.S. Pat. No. 3,704,308; U.S. Pat. No. 3,725,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247; U.S. Pat. No. 3,803,039; and U.S. Pat. No. 3,413,347.

More preferred Mannich condensates are those made by condensing a polyisobutylphenol wherein the polyisobutyl group has an average molecular weight of about 800–3,000 with formaldehyde or a formaldehyde precursor and an ethylene polyamine having the formula:

$$H_2N\text{-}(CH_2CH_2NH\text{-})_nH$$

wherein n is an integer from one to ten or mixtures thereof especially those in which n has an average value of 3–5.

Another class of ashless dispersants which can advantageously be used in the diesel fuel composition of the present invention are the imidazoline dispersants which can be represented by the formula:

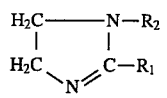

wherein $R_1$ represents a hydrocarbon group having 1 to 23 carbon atoms, e.g. an alkyl or alkenyl group having 7 to 22 carbon atoms, and $R_2$ represents a hydrogen atom or a hydrocarbon radical of 1 to 22 carbon atoms, or an aminoalkyl, acylaminoalkyl or hydroxyalkyl radical having 2 to 44 carbon atoms. Such long-chain alkyl (or long-chain alkenyl) imidazoline compounds may be made by reaction of a corresponding long-chain fatty acid (of formula $R_1$-COOH), for example oleic acid, with an appropriate polyamine. The imidazoline formed is then ordinarily called, for example, oleylimidazoline where the radical $R_1$ represents the oleyl residue of oleic acid. Other suitable alkyl substituents in the 2- position of these imidazolines include undecyl, heptadecyl, lauryl and erucyl. Suitable N-substituents of the imidazolines (i.e. radicals $R_2$) include hydroxyalkyl, aminoalkyl, acylaminoalkyl and hydrocarbon radicals such as hydroxyethyl, aminoethyl, oleylaminoethyl and stearylaminoethyl.

Other suitable ashless dispersants which may be incorporated in the diesel fuel compositions of the present invention include the products of condensation of a cyclic anhydride with a straight-chain N-alkylpolyamine of the formula:

$$R\text{-}(NH\text{-}R'\text{-})_n\text{-}NH_2$$

where n is an integer at least equal to 1, usually 3 to 5, R is a saturated or unsaturated linear hydrocarbon radical of 10 to 22 carbon atoms add R' is a divalent alkylene or alkylidene radical of 1 to 6 carbon atoms. Examples of such polyamines include N-oleyl-1,3-propanediamine, N-stearyl-1,3-propanediamine, N-oleyl-1,3-butanediamine, N-oleyl-2-methyl-1,3-propanediamine, N-oleyl-1,3-pentanediamine, N-oleyl-2-ethyl-1,3-propanediamine, N-stearyl-1,3butanediamine, N-stearyl-2-methyl-1,3-propanediamine, N-stearyl-1,3-pentanediamine, N-stearyl-2-ethyl-1,3-propanediamine, N-oleyl-dipropylenetriamine and N-stearyl-dipropylenetriamine. Such linear N-alkylpolyamines are condensed with, e.g., a succinic, maleic, phthalic or hexahydrophthalic acid anhydride which may be substituted by one or more radicals of up to 5 carbon atoms each.

Another class of ashless dispersant which can be incorporated in the compositions of the present invention are the products of reaction of an ethoxylated amine made by reaction of ammonia with ethylene oxide with a carboxylic acid of 8 to 30 carbon atoms. The ethoxylated amine may be, for example, mono-, di- or tri-ethanolamine or a polyethoxylated derivative thereof, and the carboxylic acid may be, for example, a straight or branched chain fatty acid of 10 to 22 carbon atoms, a naphthenic acid, a resinic acid or an alkyl aryl carboxylic acid.

All the aforesaid types of ashless dispersants are described in the literature and many are available commercially.

The heavy diesel fuel compositions of the present invention preferably include a combination of an ashless dispersant made by reaction of a polyolefin-succinic acid with a polyethylene polyamine and a long-chain alkyl imidazoline, preferably/in a ratio of 1 to 4 to 4 to 1 by weight. Other mixtures of ashless dispersants can, of course, also be used.

The heavy diesel fuel compositions of the present invention preferably also contain an antioxidant, e.g. a phenolic, sulphurized phenolic, or aromatic amine antioxidant. Any commercially available antioxidant compatible with the diesel fuel may be used, but preferably the antioxidant is a hydrocarbon soluble phenolic antioxidant and especially such an antioxidant in which at least one ortho position of the phenol is blocked. Examples of such phenolic antioxidants are well known in the art. Examples include 2-tert-butylphenol, 2-ethyl-6-methylphenol, 2,6-di-tert-butyl-phenol, 2,6-di-tert-butyl-4-methylphenol, 2,2'-methylene-bis-4, 6di-tert-butyl-phenol, 4,4'-methylene-bis (2,6-di-tert-butyl-phenol) and 2,2'-propylidene-bis (6-tert-butyl-4-methylphenol). Mixtures of such antioxidants can also be used.

The heavy diesel fuel compositions of the present invention may also incorporate other additives commonly used in diesel fuels and compatible with the above-mentioned constituents. Such additional additives include: cold flow improvers and pour-point depressants, e.g. olefin/vinyl acetate copolymers such as ethylene/vinyl acetate copolymers and poly(alkylmethacrylates); corrosion inhibitors and antiwear additives based on carboxylic acids, such as dimerised linoleic acid, stabilisers, e.g. aliphatic amines such as dialkyl cyclohexylamine, and antifoam agents such as silicones. Such materials are well known in the art and are used in the usual proportions.

The following Example illustrates the invention.

EXAMPLE

An additive mixture was prepared having the following composition:

| | |
|---|---|
| Methylcyclopentadienyl manganese tricarbonyl; | 4.7% by weight |
| Dispersant A; | 52.6% by weight |
| Dispersant B; | 30.5% by weight |
| 2,6-di-tert-butyl-phenol | 12.2% by weight |

Dispersant A was a polyisobutenyl succinimide ashless dispersant based on a polyisobutene having a number average molecular weight of 900 and triethylenetetramine. Dispersant B was a mixture of an imidazoline and an amide made by reaction of tall oil fatty acids with hydroxyethylethylene diamine.

The mixture also included 100 solvent neutral mineral lubricating oil to facilitate incorporation into the heavy diesel fuel.

In the first experiment, residual marine diesel fuel having a viscosity of 115 cSt at 50° C. and containing 1.9% of sulphur was treated with the aforesaid additive mixture at a treat rate of 0.066% by weight. When this treated diesel fuel was used in a single cylinder crosshead engine, a significant level of fuel economy was achieved, as compared with the untreated fuel or with the same fuel containing only the manganese compound at the same treatment rate.

In a second experiment, a residual marine diesel fuel having a viscosity of 465 cSt at 50° C. and containing 3% sulphur was treated with the same additive mixture at the same rate. The fuel was used in an Atlas medium speed diesel engine having a maximum rpm of 1200. Tests were run across the full operating speed range of the engine under the conditions used during propulsion and with the power output of the engine controlled to the same level at each test speed both with the treated and the untreated fuel. Fuel consumption was determined by measuring the brake specific fuel consumption (BSFC) and the reduction in consumption obtained using the fuel containing the additive mixture compared with the consumption obtained with untreated fuel was determined. The results were as follows:

| ENGINE SPEED RPM | % REDUCTION BSFC |
|---|---|
| Average over range 900–1200 | 1.4 |
| 1150 | 2.2 |

Having regard to the large amounts of fuel used by such engines, this represents a valuable increase in operating efficiency.

Further tests were carried out on a ship operating at sea and fitted with a Sulzer RD68 engine as the main propulsion engine and also with an auxiliary diesel engine for operating shipboard equipment. The main engine was fuelled with heavy residual marine diesel fuel having a viscosity of 100 cSt at 50° C. and containing 4% sulphur. The auxiliary diesel engine was supplied with fuel having a viscosity of 15 cSt at 50° C. and containing 2% sulphur. Each engine was supplied with untreated fuel for two weeks, then with treated fuel for two periods each of two weeks, and finally with untreated fuel again for a further period of two weeks. The treated fuel for the main engine contained 0.066% by weight of the additive package described above and the fuel for the auxiliary engine contained 0.05% by weight of the additive package described above.

It was found that the improvement in fuel economy (i.e. % reduction in fuel consumption) for the main engine was 1.5% and for the auxiliary engine was 2.5%.

What is claimed is:

1. A heavy diesel fuel composition comprising (i) a major amount of a heavy residual diesel fuel having a viscosity of at least about 100 cSt at 50° C. and a sulfur content of at least about 1% by weight, (ii) at least one cyclomatic manganese tricarbonyl and (iii) at least one ashless dispersant, (ii) and (iii) being present in said fuel in amounts and proportions such that said fuel composition exhibits an improved fuel economy as compared to the same fuel composition not containing said ashless dispersant.

2. A composition according to claim 1 in which the proportion of the cyclomatic manganese tricarbonyl is from 0.00025 to 0.15% and the proportion of the ashless dispersant is from 0.0125 to 0.99%, both percentages being by weight based on the weight of the fuel.

3. A composition according to claim 1 in which the proportion of the cyclomatic manganese tricarbonyl is from 0.000625 to 0.075% by weight and the proportion of the ashless dispersant is from 0.025to 0.495% by weight, both percentages being based on the weight of the fuel.

4. A composition according to claim 3 in which the ashless dispersant is (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, (2) an imidazoline dispersant of formula

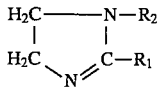

where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms, or a mixture of such dispersants (1) and (2).

5. A composition according to claim 3 in which the ashless dispersant comprises a mixture of (1) the product of reaction of triethylene tetramine or tetraethylene pentamine with the reaction product of a polyisobutene having a number average molecular weight in the range of 900 to 1200 with maleic anhydride, and (2) an imidazoline dispersant of the formula

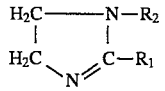

wherein $R_1$ represents alkyl or alkenyl of 7 to 22 carbon atoms and $R_2$ represents hydroxyethyl.

6. A composition according to claim 1 which also comprises an antioxidant.

7. A composition according to claim 6 in which the proportion of the antioxidant is 0.01 to 0.1% by weight based on the weight of the fuel.

8. A composition according to claim 6 in which the ashless dispersant is (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, (2) an imidazoline dispersant of formula

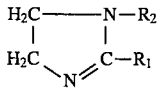

where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms, or a mixture of such dispersants (1) and (2).

9. A composition according to claim 8 in which the ashless dispersant comprises a mixture of (1) the product of reaction of triethylene tetramine or tetraethylene pentamine with the reaction product of a polyisobutene having a number average molecular weight in the range of 900 to 1200 with maleic anhydride, and (2) an imidazoline dispersant of the formula

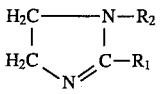

wherein $R_1$ represents alkyl or alkenyl of 7 to 22 carbon atoms and $R_2$ represents hydroxyethyl.

10. A composition according to claim 6 in which the antioxidant is a hydrocarbon-soluble phenolic antioxidant in which at least one ortho position of the phenol is blocked.

11. A composition according to claim 10 in which the phenolic antioxidant is 2,6-di-tert-butylphenol or 2,6-di-tert-butyl-4-methylphenol.

12. A composition according to claim 1 in which said cyclomatic manganese tricarbonyl is cyclopentadienyl manganese tricarbonyl, methylcyclopentadienyl manganese tricarbonyl, indenyl manganese tricarbonyl, or ethylcyclopentadienyl manganese tricarbonyl.

13. A composition according to claim 1 in which the ashless dispersant is (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, (2) an imidazoline dispersant of formula

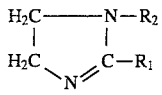

where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms, or a mixture of such dispersants (1) and (2).

14. A composition according to claim 13 in which the ashless dispersant comprises a mixture of (1) the product of reaction of triethylene tetramine or tetraethylene pentamine with the reaction product of a polyisobutene having a number average molecular weight in the range of 900 to 1200 with maleic anhydride, and (2) an imidazoline dispersant of the formula specified in claim 7 wherein $R_1$ represents alkyl or alkenyl of 7 to 22 carbon atoms and $R_2$ represents hydroxyethyl.

15. A composition according to claim 14 which also comprises at least one hydrocarbon-soluble phenolic antioxidant in which at least one ortho position of the phenolic antioxidant is blocked.

16. A composition according to claim 1 in which the ashless dispersant is a mixture of (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, and (2) an imidazoline dispersant of formula

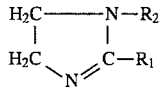

where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms.

17. A composition according to claim 16 which also comprises at least one hydrocarbon-soluble phenolic antioxidant in which at least one ortho position of the phenolic antioxidant is blocked.

18. An additive package for incorporation in a heavy diesel fuel, said package comprising from about 2.5 to about 7.5% by weight based on the total weight of the package of at least one cyclomatic manganese tricarbonyl, from about 70 to about 90% by weight based on the total weight of the package of at least one ashless dispersant, at least one antioxidant, and optionally, a liquid diluent.

19. A package act according to claim 18 in which the ashless dispersant is a mixture of (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, and (2) an imidazoline dispersant of formula

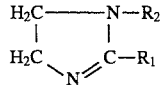

where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms.

20. A package according to claim 19 wherein said antioxidant consists essentially of at least one hydrocarbon-soluble phenolic antioxidant in which at least one ortho position of the phenolic antioxidant is blocked; and wherein said package contains at least one liquid diluent.

21. A package according to claim 18 in which the ashless dispersant comprises a mixture of (1) the product of reaction of triethylene tetramine or tetraethylene pentamine with the reaction product of a polyisobutene having a number average molecular weight in the range of 900 to 1200 with maleic anhydride, and (2) an imidazoline dispersant of the formula

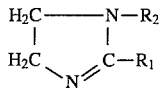

wherein $R_1$ represents alkyl or alkenyl of 7 to 22 carbon atoms and $R_2$ represents hydroxyethyl.

22. A package according to claim 21 wherein said antioxidant consists essentially of at least one hydrocarbon-soluble phenolic antioxidant in which at least one ortho position of the phenolic antioxidant is blocked; and wherein said package contains at least one liquid diluent.

23. In a marine vessel having a main marine diesel engine for providing power for propelling said vessel and an auxiliary diesel engine for operation auxiliary equipment of said vessel, each of said engines having its own supply of diesel fuel, the improvement wherein the fuel supplied to said main marine diesel engine comprises:

(i) a major amount of a heavy residual diesel fuel having a viscosity of at least about 100 cSt at 50° C. and a sulfur content of at least about 1% by weight, (ii) at least one cyclomatic manganese tricarbonyl, and (iii) at least one ashless dispersant, (ii) and (iii) being present in said fuel (i) in amounts and proportions such that the operation of said main diesel engine with said fuel composition results in improved fuel economy as compared to the same type of operation of said main diesel engine with the same fuel composition not containing said ashless dispersant; and wherein the fuel supplied to said auxiliary diesel engine comprises:

(iv) a major amount of a heavy diesel fuel having a viscosity and a sulfur content lower than fuel (i), (v) at least one cyclomatic manganese tricarbonyl, and (vi) at least one ashless dispersant, (v) and (vi) being present in said fuel (iv) in amounts and proportions such that the same type of operation of said auxiliary diesel engine with said fuel composition results in improved fuel economy as compared to the same type of operation of said auxiliary diesel engine with the same fuel composition not containing said ashless dispersant.

24. A marine vessel in accordance with claim 23 wherein the ashless dispersants (iii) and (vi) are mixtures of (1) a product of a reaction between a polyethylene polyamine and a hydrocarbon-substituted carboxylic acid or anhydride made by reaction of a polyolefin having a molecular weight from 500 to 5,000 with an unsaturated polycarboxylic acid or anhydride, and (2) an imidazoline dispersant of formula

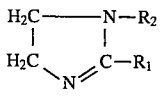
where $R_1$ represents a hydrocarbon group having 1 to 23 carbon atoms and $R_2$ represents a hydrogen atom or a hydrocarbon radical of 1 to 22 carbon atoms, or an aminoalkyl, acylaminoalkyl or hydroxyalkyl radical having 2 to 44 carbon atoms; and wherein said fuels (i) and (iv) additionally contain at least one hydrocarbon-soluble antioxidant.
* * * * *